United States Patent [19]

Alevras

[11] B 4,000,562

[45] Jan. 4, 1977

[54] VACUUM HAIRCUTTING APPARATUS AND METHOD

[76] Inventor: Constantino J. Alevras, 542 Gruman Court, Riverdale, N.J. 07675

[22] Filed: May 29, 1975

[21] Appl. No.: 581,843

[44] Published under the second Trial Voluntary Protest Program on March 16, 1976 as document No. B 581,843.

[52] U.S. Cl. ..... 30/133; 132/45 R

[51] Int. Cl.[2] ..... B26B 19/20; B26B 19/44

[58] Field of Search ..... 30/133, 131; 132/45 R, 132/45 A; 83/22, 24

[56] References Cited

UNITED STATES PATENTS

| | | | |
|---|---|---|---|
| 1,331,218 | 2/1920 | Severson | 30/133 |
| 2,523,201 | 9/1950 | Ellis | 30/133 X |
| 3,654,699 | 4/1972 | Garcia | 30/133 |

*Primary Examiner*—Al Lawrence Smith
*Assistant Examiner*—J. C. Peters
*Attorney, Agent, or Firm*—Charles J. Speciale

[57] ABSTRACT

An apparatus for cutting hair employing vacuum suction which comprises an elongated hollow tapered body open at either end, the tapered body being provided with additional graduated opening means along its length so that by applying a source of vacuum suction to one end of the body while the other end is applied to the subject's hair and head, the hair will be drawn up through the tapered body and the hair will be cuttable through the aforesaid graduated opening means. A method of vacuum suction haircutting by means of this device.

6 Claims, 4 Drawing Figures

VACUUM HAIRCUTTING APPARATUS AND METHOD

BACKGROUND OF THE INVENTION

1. Field of the Invention

This invention relates to an apparatus useful in cutting hair uniformly by vacuum action and to a method of vacuum haircutting.

2. Description of the Prior Art

Haircutting of course, is a well known art. It is also well known that it generally takes an artisan to give a good haircut. It would be desirable if a way could be found to give the average person a means to cutting hair without having artisan skills.

SUMMARY OF THE INVENTION

It is therefore among one of the principal objectives to provide an apparatus for cutting hair which can be used by anyone who may not necessarily have artisan skills.

In accord with the present invention there is now provided an apparatus for cutting hair by means including vacuum suction which comprises an elongated hollow tapered body open at either end, said tapered body being provided with additional opening means at graduated intervals along its length so that the application of a source of suction to one open end of the tapered body while its other open end is applied to a subject's hair results in the hair being drawn up through the hollow tapered body where it will be cuttable through the graduated opening means. A method of vacuum suction haircutting by means of this device.

BRIEF DESCRIPTION OF THE DRAWINGS

The invention will be hereinafter more fully described with reference to the accompanying drawing in which.

DESCRIPTION OF THE PREFERRED EMBODIMENTS

Figure 1:
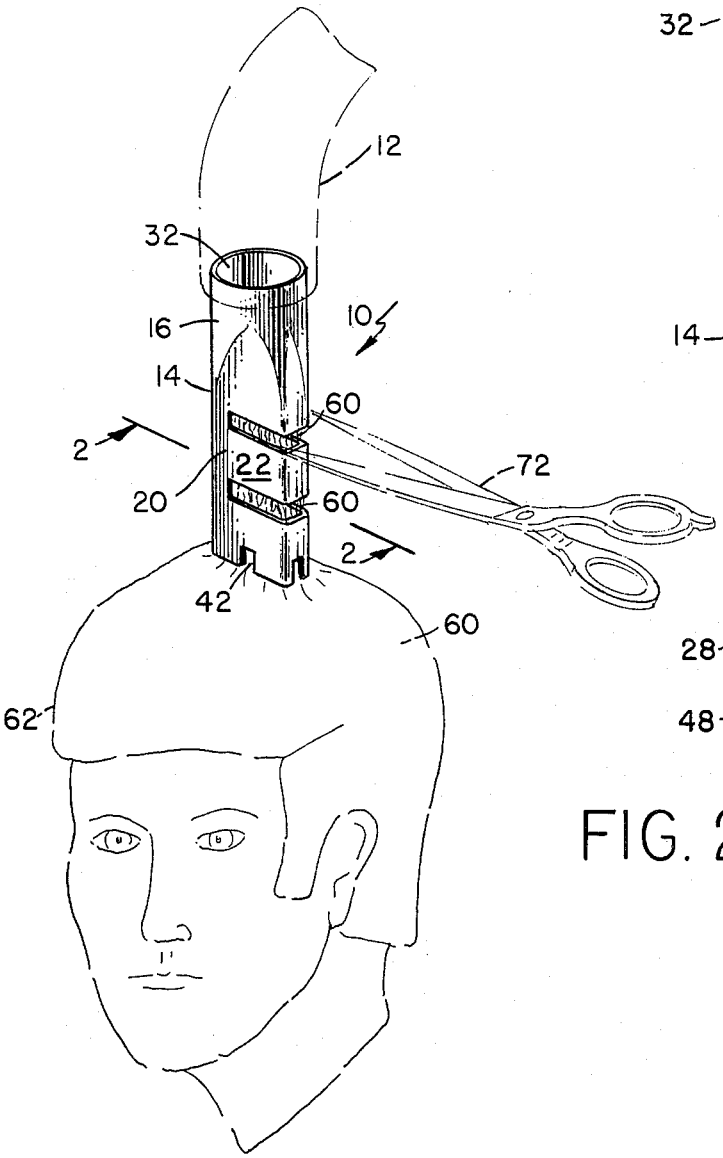
FIG. 1 is a view in perspective of the invention device illustrating its use in conjunction with a source of vacuum.
Figure 2:
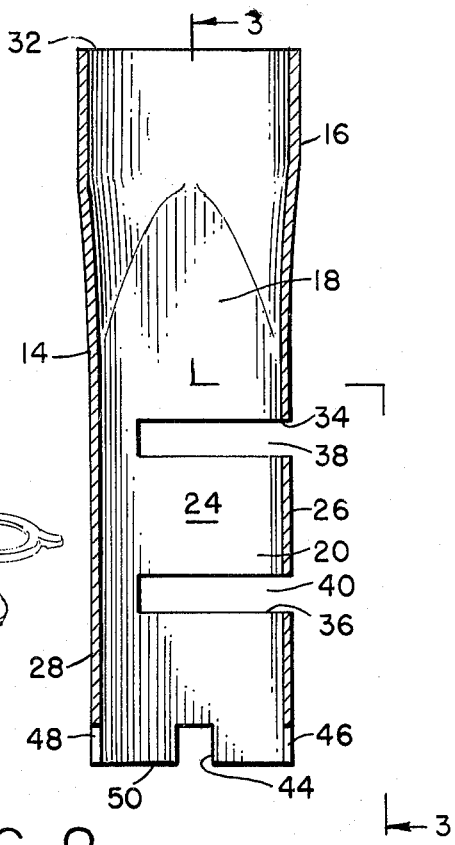
FIG. 2 is a view of a side elevational cross-section of the device in FIG. 1 along line 2—2 thereof in the direction of the arrows.
Figure 3:
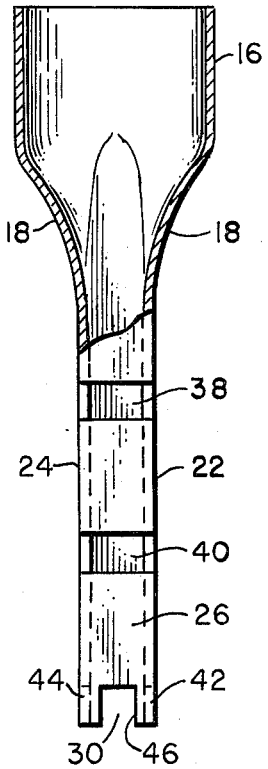
FIG. 3 is a partial end elevational cross-sectional view of the device in FIG. 2 along line 3—3 thereof in the direction of the arrows.
Figure 4:
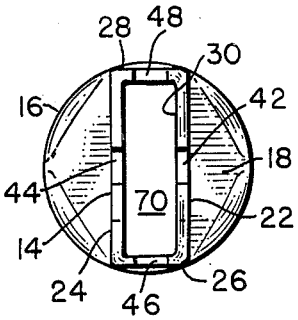
FIG. 4 is a bottom plan view of the device.

Referring now to the figures of drawing, there is shown therein the haircutting apparatus 10 of the invention to be used in conjunction with a source of conventional vacuum suction 12 (shown only partially in phantom lines). The apparatus further comprises an elongated tapered hollow body 14 having an upper annular portion 16 which tapers down as at 18 to an essentially rectangular shaped shank portion 20, so that the shank portion roughly comprises about two-thirds of the apparatus, but this ratio is not critical to the invention since it may be varied somewhat therefrom. Thus shank portion 20 has a pair of parallel opposing lateral side walls 22, 24 and a pair of parallel opposing end walls 26, 28. Shank portion 20 terminates in a generally rectangular shaped opening 30 while upper annular portion 16 terminates in a generally circular opening 32.

The shank portion is further provided with a pair of rectangular shaped slots 34 and 36. Slots 34 and 36 are transversely oriented along the shank and parallel to each other, and being at end wall 26 and terminate short of end wall 28, forming openings 38 and 40 respectively, in end wall 26. Slots 36 and 34 are spaced apart, respectively, from the bottom end 50 of the device, at a ratio of about 1:2 from said bottom end.

The depth of the slots should be sufficient to accommodate comfortably the cutting ends of the average haircutting scissors, for a reason that will become more readily apparent subsequently. The function of these slots will be described hereinbelow but the ratio of 1:2 may be varied as desired. Additionally, the ends of side walls 22 and 24, and the end walls 26 and 28, are respectively notched as at nothces 42, 44, 46 and 48. These notches are generally rectangular shaped and their function will be described hereinbelow.

The tapered body forming the device is made up of a hard plastic material, preferably a clear one.

Describing now the operation of the invention in giving a haircut using same, what is done is to fit the upper annular portion 16 of the apparatus into a vacuum hose connected to a suitable source of suction, e.g., conventional vacuum cleaner. The vacuum motor is then switched on and the bottom end 50 of the device is brought to bear against the hair 60 to be cut on the subject's head 62 (shown only in phantom lines). Naturally, because of the suction force passing through the hollow tapered body making up the device, the hair is resultingly drawn up through the hollow chamber 70 in the direction of the force exerted. The operator then can proceed to cut the hair via the scissors 72 by applying the scissor cutting action through either of the slots 34 or 36. If a "short" haircut is required the haircutting is done through the lower slot 36. If a "long" haircut is desired the cutting is done through the upper slot 34. Notches 42, 44, 46 and 48 enhance the "grabbing" action of the vacuum force. The device is then moved systematically over the entire head of hair until a uniform cut is achieved. By virtue of the fact that the body of the device may be clear plastic, it makes it that much easier to see what the operator is cutting. By virtue of the fact that the slots are graduated it makes it that much easier to give a "short" or a "long" haircut and a uniform one at that. Moreover, you don't have to be a skilled barber in order to be able to cut hair. Anyone can do it with the invention device.

What is claimed is:

1. Vacuum haircutting apparatus comprising an elongated hollow tapered body having an open upper end and an open bottom end and forming an elongated chamber, said tapered body being provided with additional opening means at graduated intervals along its length communicating with said chamber, so that the application of a source of vacuum suction to said open upper end while said open bottom end is applied to a subject's hair results in said hair being drawn up through said chamber whereby said hair will be cuttable through said additional opening means.

2. Apparatus according to claim 1 wherein said tapered body further comprises an upper annular portion and a lower rectangular shaped shank portion, said annular portion tapering down to and integral with said shank portion.

3. Apparatus according to claim 2 wherein said shank portion contains said additional opening means, said additional opening means further comprising a pair of spaced, parallel, transversely oriented rectangular shaped slots, forming an upper slot and a lower slot.

4. Apparatus according to claim 3 wherein said rectangular shaped shank portion further comprises a pair of parallel opposing side walls and a pair of parallel opposing end walls, said rectangular shaped slots each being cut into one of said end walls and partially into said side walls, each slot forming an opening into said chamber.

5. Apparatus according to claim 4 wherein the bottom ends of each of said side and end walls are notched.

6. A method of vacuum haircutting so that the hair is cut in uniform lengths which comprises applying to the hair a hollow body containing graduated opening means, subjecting a suction force on said hair through said hollow body thereby drawing said hair forceably through said hollow body and cutting said drawn hair through one of said graduated opening means.

* * * * *